United States Patent [19]

Bruening

[11] 4,406,377

[45] Sep. 27, 1983

[54] LOW FRICTION SEAL FOR A FLOATING ROOF

[76] Inventor: Robert A. Bruening, 1541 Chippewa Dr., Naperville, Ill. 60540

[21] Appl. No.: 384,863

[22] Filed: Jun. 4, 1982

Related U.S. Application Data

[63] Continuation of Ser. No. 183,624, Sep. 2, 1980, which is a continuation-in-part of Ser. No. 53,947, Jul. 2, 1979, abandoned.

[51] Int. Cl.[3] ..... B65D 87/20

[52] U.S. Cl. ..... 220/222; 220/221

[58] Field of Search ..... 220/222, 216, 223, 224, 220/225, 226; 428/124

[56] References Cited

U.S. PATENT DOCUMENTS

| | | | |
|---|---|---|---|
| 2,656,263 | 10/1953 | Larsen | 220/216 X |
| 2,873,042 | 2/1959 | Fino | 220/222 |
| 3,086,216 | 4/1963 | Brooks et al. | 428/124 X |
| 3,373,891 | 3/1968 | Kidd | 220/222 |
| 4,116,358 | 9/1978 | Kinghorn et al. | 220/222 |
| 4,130,217 | 12/1978 | Hills et al. | 220/226 |
| 4,191,303 | 3/1980 | Kinghorn, Sr. et al. | 220/226 X |
| 4,276,991 | 7/1981 | Gunther | 220/223 |

*Primary Examiner*—Steven M. Pollard

*Attorney, Agent, or Firm*—Merriam, Marshall & Bicknell

[57] ABSTRACT

An elastomeric composite strip, impermeable to petroleum vapor and useful as a seal in a floating roof tank, having thereon a layer of woven or nonwoven fabric or cloth of a polymeric material with a substantially lower coefficient of friction than the material otherwise comprising the surface of the elastomeric strip thereby providing a slick face adapted to essentially always contact a surface with which it has slidable contact with little or no sticking.

12 Claims, 10 Drawing Figures

LOW FRICTION SEAL FOR A FLOATING ROOF

This is a continuation of application Ser. No. 183,624, filed Sept. 2, 1980 which is a continuation-in-part of application Ser. No. 53,947 filed July 2, 1979 now abandoned.

This invention relates to an improvement in floating roof tanks used for the storage of petroleum products or other volatile liquid materials, and in particular relates to an improved seal for a floating roof.

In a conventional floating roof tank, with which the seal of the invention is particularly useful, there is provided a clearance space or rim space between the tank side wall and the vertical rim of the roof. It is necessary to provide clearance space to permit unrestrained vertical travel of the roof within the tank. The clearance space is of sufficient size that local dimensional variations in the circularity of the tank sidewall or shell, commonly called out-of-roundness, which can result from uneven foundation settlement, imprecise fabrication or erection or unusual live loads such as high winds and the like, do not hamper vertical travel of the roof.

A conventional system for centering a floating roof in a tank and simultaneously sealing the space between the roof rim and the tank inner side wall employs as a sealing means a yieldable annulus suspended by the roof and extending from contact with the roof rim into contact with the tank wall. The annulus can be made of flexible sheet material and can contain a fluid, i.e. liquid or gas, such as water or nitrogen, or a resilient material such as a polymeric foamed material. U.S. Pat. Nos. 3,136,444; 3,120,320; 3,075,668; 3,055,533; 2,973,113 and 2,968,420 illustrate seals of those types.

Other apparatus to maintain the roof centered in the tank and to effect a seal against evaporation loss uses a plurality of vertical shoes adapted to slidably contact the entire circular inner side wall of the tank and means supported by the roof for pressing the shoes against the inner side wall, as well as to support the shoes. Vapor loss between the roof and shoes is prevented by a flexible nonpermeable fabric barrier which extends from the upper part of the shoes to the floating roof top edge. Such apparatus is disclosed in many U.S. Pat. Nos. including 2,587,508; 2,630,937; 2,649,985 and 2,696,930.

Although such types of seals function quite well in commercial installations some product vapor may still escape past the seal. This possibility is substantially increased on windy days since air flow over the floating roof creates a negative pressure over part of the circumference at the seal, and positive pressure over the other part. The positive wind pressure will usually be located in the semicircular rim clearance space downwind from the center of the roof and the negative pressure upwind. When the negative pressure is created the higher vapor pressure leads to flow of vapor, from beneath the sealing means, between the seal and the tank inner wall into the atmosphere. Similarly, the positive pressure causes air to flow into the vapor space, thereby setting up a flow around the vapor space and out the negative side carrying vapor with the flow. This results in undesirable air pollution. There is accordingly a need for improvements in such liquid storage tank floating roof seals and materials used in such seals.

Wiper type seals are also disclosed in the prior art and are used alone as a primary seal, or as a secondary seal in conjunction with a primary seal such as those already described. See U.S. Pat. Nos. 2,190,476; 1,698,158; 2,873,042; 2,973,113; and 3,372,831. U.S. Pat. No. 2,973,113 discloses a secondary wiper seal made of rubber with a reduced thickness hinge portion reinforced with embedded nylon. U.S. Pat. No. 2,190,476 discloses a primary seal in the form of a pear-shaped loop of sheet material with resilient metal strips embedded therein in spaced relation to each other. It is believed that such wiper seals will not produce the vapor seals now needed to prevent vapor emissions adequately to meet present day environmental air purity standards.

U.S. Pat. No. 4,138,032 discloses a secondary seal made of an elastomeric strip impermeable to petroleum vapor comprising a plurality of flexible resilient elongated stiffeners laterally positioned and embedded in elastomeric material. The patent discloses that as the roof is displaced up and down, the elastomeric strip can be flexed from an upwardly curved arch to a downwardly curved arch and vice versa. This is largely due to the relatively high coefficient of friction between the rubber strip used for the seal and the metal tank wall. In many tanks, it is undesirable for the sealing strip to flip-flop, as indicated, with vertical displacement of the roof. A better, more continuous seal is quite often obtained when the sealing strip stays continuously in an upwardly or downwardly arched condition during and after vertical displacement of the roof, whether the movement is up or down.

According to one aspect of the present invention, there is provided an improved elastomeric strip, impermeable to petroleum vapor, and useful as a seal in a floating roof tank, characterized by having a slick face adapted to at all times contact a surface with which it has slidable contact, such as a tank wall, with little, if any, sticking. The slick face is achieved by applying, on a removable or nonremovable basis, a layer of antifriction material having a lower coefficient of friction than the material otherwise comprising the surface of the elastomeric strip. The slick face prevents the strip, when used as a seal, from sticking and flip-flopping with vertical movement of a floating roof.

The antifriction material can comprise a woven or non-woven fabric or cloth, or a flexible sheet of polymeric material fastened to the elastomeric strip by any suitable means, such as by vulcanizing or by an adhesive, clips, stitching, riveting, or by some other mechanical fastening means. The woven fabric or cloth, and the nonwoven fabric or cloth, such as a web of random fibers matted together as a felt, can be applied to the surface of, or be at least partially embedded in, the elastomeric strip so as to be nonremovably attached thereto when the rubber of which the elastomeric strip is made is vulcanized.

It is generally desirable to install the woven or nonwoven fabric or cloth in separate pieces, each piece being about 2 inches (5.08 cm.) wide and arranged in closely spaced, side-by-side relation on the elastomeric strip face so that a portion of each piece of fabric is carried on each of the opposite surfaces of the elastomeric strip and extends around one of the side edges thereof. Consequently, the fabric at all times contacts the tank wall surface and, by using narrow width pieces, stretching of the elastomeric strip is readily accommodated as the composite strip moves close to and then away from the tank wall. The slick face can also comprise a polymeric material applied as a thermoplastic or thermosetting coating or layer and bonded directly to the face of the strip.

Some of the polymeric materials which can be used to provide the slick face are nylon, polyethylene, a polyfluoroethylene such as Teflon, or a polychlorofluoroethylene.

According to a further aspect of the invention there is provided an improvement in a vertical cylindrical liquid storage tank of imprecise circularity having a circular floating roof of smaller diameter than the tank thereby defining a vapor space between the roof edge and the tank wall, and an elastomeric strip impermeable to vapor connected at its inner edge by an essentially vapor tight joint to the roof edge and extending as an annulus arched outwardly, upwardly or downwardly, to the tank inner side wall, for substantially preventing flow of vapor from a liquid product stored in the tank through the vapor space to the atmosphere, with the improvement comprising a layer of woven or nonwoven polymeric fabric or cloth on that portion of the face of the elastomeric strip which is adapted to substantially at all times make contact with the tank inner side wall, said polymeric fabric having a substantially lower coefficient of friction than that of the elastomeric strip to thereby provide a slick face slidably movable against the said tank wall to thereby negate reverse arching of the strip with vertical movement of the floating roof relative to the tank wall.

The invention will be described further in conjunction with the attached drawings, in which.

Figure 5:
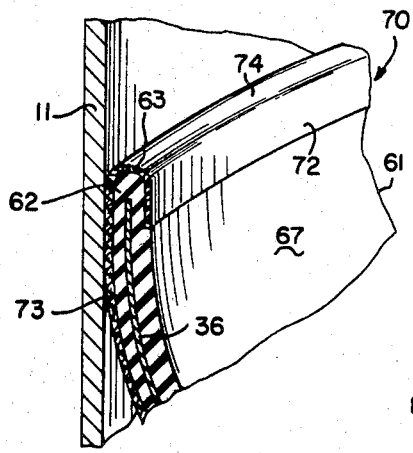
FIG. 5 is an enlarged, fragmentary perspective view, similar to FIG. 2, of the portion of the secondary sealing strip that engages the inner side wall of the tank and showing a layer of polymeric fabric or cloth partially embedded in the opposite surfaces of the strip.
Figure 6:
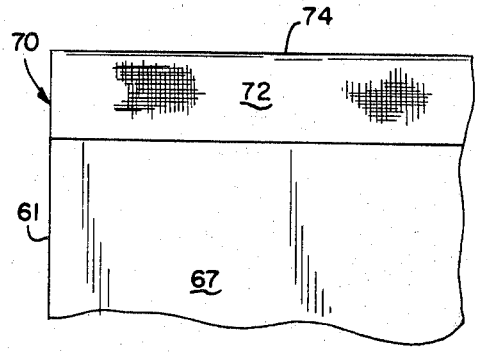
FIG. 6 is a fragmentary plan view of a portion of the radially inner surface of the secondary seal strip, and the partially embedded layer of polymeric fabric illustrated in FIG. 5, both of which do not normally engage the tank inner side wall.
Figure 8:
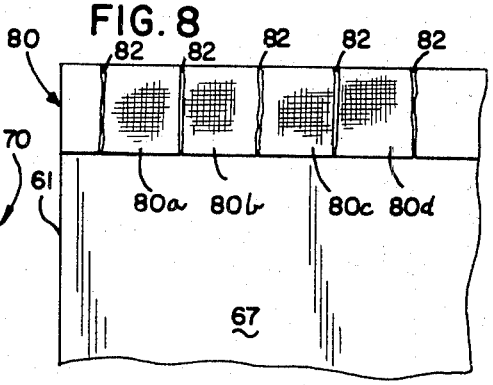
Figure 7:
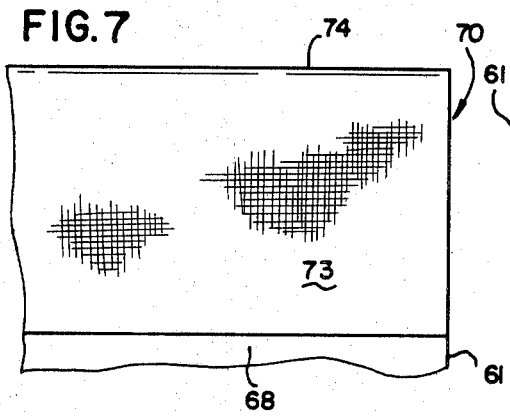
FIG. 7 is a fragmentary plan view of a portion of the radially outer surface of the secondary seal strip and the partially embedded layer of polymeric fabric illustrated in FIG. 5, only a part of the outer surface of the polymeric fabric normally engaging the tank inner side wall.
Figure 10:
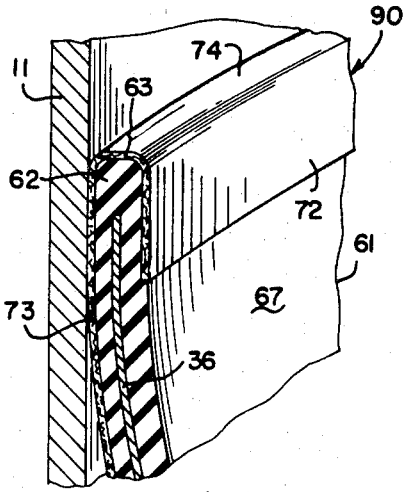
Figure 9:
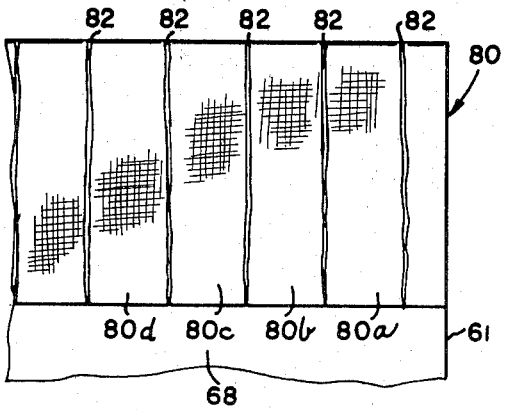

FIGS. 8 and 9 are fragmentary plan views, similar to FIGS. 6 and 7, respectively, but showing an alternate construction of the layer of polymeric fabric or cloth that is partially embedded in the radially inner and outer surfaces of the secondary seal strip; and FIG. 10 is an enlarged, fragmentary perspective view, similar to FIG. 5, of the radially outer edge portion of the secondary seal strip that engages the inner side wall of the tank, a layer of polymeric felt being shown partially embedded in the edge portion of the strip.

So far as is practical, the same parts or elements which appear in the various views of the drawings will be identified by the same numbers.

Figure 1:
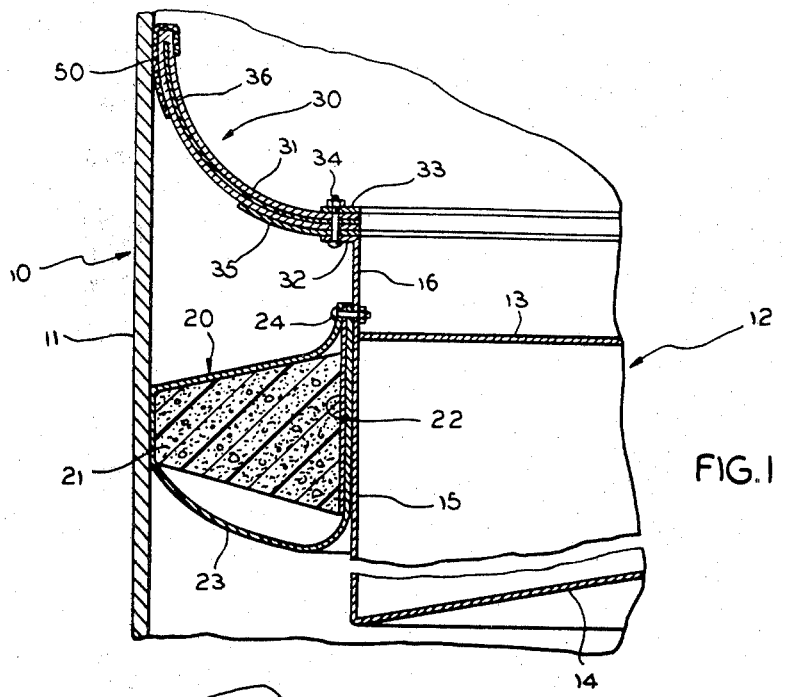
FIG. 1 is a vertical sectional view through a tank and the edge of a floating roof having a primary seal and a secondary seal strip.

With reference to FIG. 1, the tank 10 has a vertical circular cylindrical wall 11 in which floating roof 12 is located. The floating roof 12 has a top 13, bottom 14 and a vertical side 15 having an upper portion 16 which extends above top 13.

Mounted around the periphery of the floating roof are primary seal 20 and secondary seal 30. The primary seal 20 if of known construction and comprises a polymeric flexible and resilient foam annulus 21 bonded to a vertical circular metal plate 22. Vapor and liquid impervious fabric envelope 23 loosely surrounds the foam annulus 21. The ends of the fabric envelope 23 are brought together in contact with the top edge of metal plate 22 and fastened by bolts 24 to the upper portion 16 of the floating roof.

Figure 2:
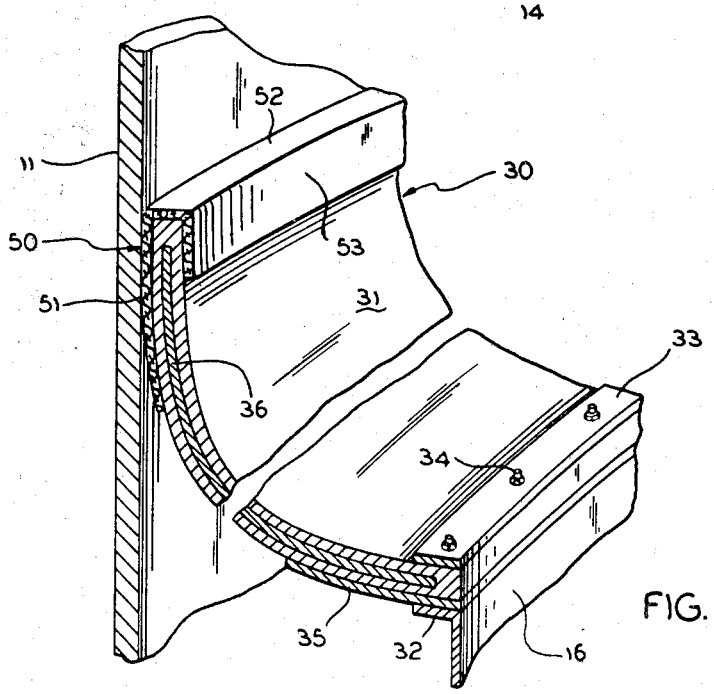
FIG. 2 is an enlarged partial view in perspective of the secondary sealing strip shown in FIG. 1.

To further guard against escape of vapor between the edge of the roof and the tank wall, the primary seal 20 is supplemented by secondary seal 30 which comprises elastomeric composite strip 31, impermeable to vapor, having its radially inner edge connected to the roof edge flange 32 by metal band 33 and bolts 34. The composite strip 31, as shown in FIGS. 1 and 2, is normally flat but after installation on a floating roof it arches upwardly since its width is always greater than the maximum distance between its place of connection to the floating roof and the tank wall. A curved support 35 helps to hold strip 31 and to keep it from reversing the direction in which it is arched. Due to its flexible, spring-like inherent properties, which continually seek to return it to its natural flat state in which it is manufactured, the radially outer or peripheral-edge of the strip 31 is urged towards the tank wall.

Figure 3:
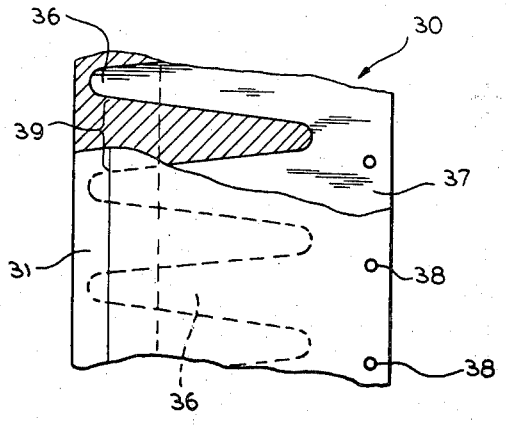
FIG. 3 is a plan view, partially in section and partially broken away, of the secondary seal of FIGS. 1 and 2 laying flat.

The specific strip 31 as shown in FIG. 3 has a plurality of flexible resilient elongated stiffeners 36 laterally positioned and embedded in elastomeric material, which can be synthetic rubber, such as neoprene. The stiffeners may be roughened or otherwise prepared to improve bonding with the elastomeric material. The stiffeners 36 as shown in FIG. 3 are integrally joined to a band portion 37 along the strip edge. Spaced apart bolt holes 38 may extend entirely through strip 31 and receive bolts 34 when the strip is joined to the floating roof.

The stiffeners 36, as shown in FIG. 3, are flat fingers which are tapered and narrower at the edge of the strip 31 which contacts the tank wall than at the edge which is joined to the floating roof. This form of stiffener is particularly useful since the tapering fingers provide wide areas 39 of elastomeric material which provide excellent and necessary circumferential elasticity in strip 31 to press against the tank wall with increase in the radial space between the roof edge and the tank wall. Also, by using tapered stiffeners progressively greater stiffness of the total seal is achieved, i.e. it is stiffer at the roof rim and decreasingly stiff as it extends closer to the tank shell.

The flexible resilient elongated stiffeners can be made of metal, such as spring steel or spring aluminum, or they can be made of a solid polymeric sheet material having the necessary physical properties, such as nylon, polypropylene or even a glass fiber impregnated polymeric material as for example polymethacrylate.

To prevent the secondary sealing strip 31 from sticking, or resisting slidable movement, against the tank wall surface during up and down vertical displacement of the floating roof in the tank when a liquid product is supplied to or removed from the tank, a sheet 50 of polymeric material is placed on the strip 30. The sheet 50 has a front 51, and end 52 and a flange 53 spaced outwardly from, but parallel to, front 51 thereby defining a groove into which nests the outer edge portion of the strip 31. This mechanical attachment in itself can often be enough to hold sheet 50 in place.

Sheet 50 is made of a polymeric material which provides a slick surface which facilitates slidable movement against the tank wall. Materials such as those described and identified previously herein can be used.

Sheet 50 can be made from sheet polymeric material shaped into the described form or it can be molded or extruded into the desired shape. Regardless of the particular shape, or the specific polymeric material used, it is desirable for the outer edge of the strip 31 to be covered so that it will always be able to slide freely against the tank wall.

In an exemplary embodiment, the sheet 50 is made of a closely woven nylon fabric about 0.025 inch thick and bonded to the strip 31. The front 51 is about 3 inches, end 52 is about 0.25 inch and flange 53 is about 1.0 inch wide.

Figure 4:
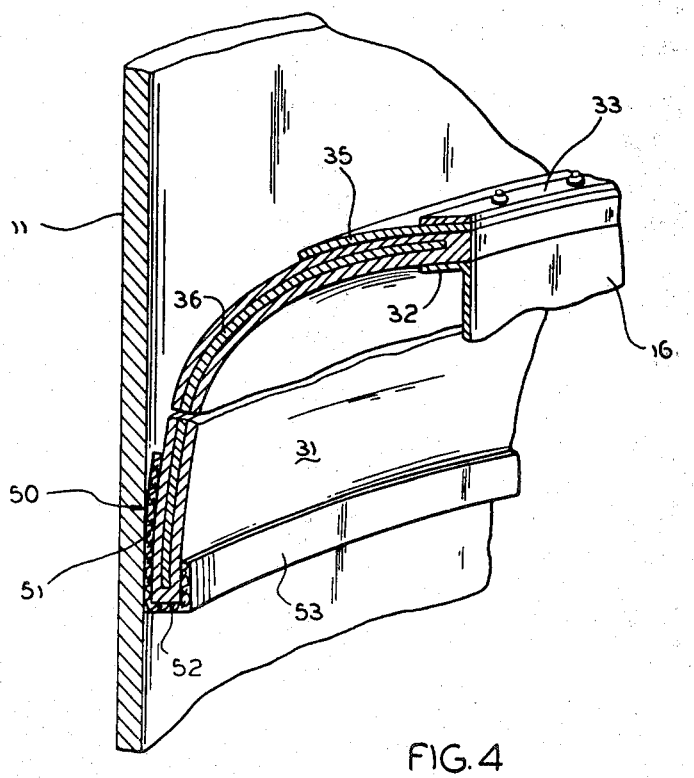
FIG. 4 is a view like FIG. 2 except that the sealing strip is arched downwardly instead of upwardly.

FIG. 4 illustrates the embodiment of FIG. 2 but with the secondary seal arched in a downwardly direction. In all other respects the construction is the same in both instances except that in FIG. 4 the support 35 is above the strip 31 rather than below it as in FIG. 2.

In FIG. 5, a portion of another elastomeric composite strip 61, embodying the features of the present invention, is illustrated. The strip 61 may be mounted in the same manner as the strip 31, i.e. the radially inner edge thereof (not shown) may be connected to the upper portion (FIGS. 1 and 2) of the floating roof 12 by a metal band 33 and bolts 34.

The composite strip 61 is also similar to the composite strip 31 in that the strip 61 is normally flat but, after installation on a floating roof, it arches upwardly since its width is always greater than the maximum distance between its place of connection to the floating roof and the tank wall. A curved support (not shown) may also be provided to help hold the strip 61 and to keep it from reversing the direction in which it is arched. Because of the flexible, spring-like inherent properties of the material of the strip 61, the radially outer edge portion thereof, indicated at 62, continually seeks to return to the natural flat state in which it was manufactured. Thus, the radially outer or peripheral edge portion 62 of the strip 61 is urged toward the inner surface of the tank wall 11 at all times when the secondary seal is installed on the roof 12.

The strip 61 also preferably includes a plurality of elongated flexible, resilient stiffeners (not shown), such as the stiffeners 36 of the strip 31. Thus, the stiffeners in the strip 61 may extend laterally of the strip and may be embedded in the elastomeric material thereof. The stiffeners are preferably tapered and narrower at the radially outer edge portion 62 of the strip 61 so that the seal is stiffest at the roof rim and decreasingly stiff as it extends closer to the inner surface of the tank wall 11.

Referring now to FIGS. 6 and 7 in conjunction with FIG. 5, it will be seen that a woven layer of polymeric fabric or cloth, indicated generally at 70, is carried on the radially outer edge indicated at 63, and portions of the radially inner and outer surfaces, indicated at 67 and 68, respectively, of the strip 61 to provide a slick face which prevents the secondary sealing strip 61 from sticking or resisting sliding movement against the inner surface of the tank wall 11 during up and down vertical displacement of the floating roof 12. According to the present invention, the layer of polymeric fabric 70 is formed from woven filaments of polymeric material such as nylon, polyethylene, a polyfluoroethylene such as Teflon, or a polychlorofluoroethylene. Thus, the layer of woven polymeric fabric or cloth 70 has a portion 72 carried on the radially inner surface 67 of the elastomeric strip 61, another portion 73 carried on the radially outer surface 68 of the elastomeric strip 61, and a portion 74 which extends around the radially outer edge 63 of the elastomeric strip 61 and connects the portions 72 and 73.

According to the present invention, the layer of woven polymeric fabric or cloth 70 is at least partially embedded in the radially inner and outer surfaces 67 and 68 of the elastomeric strip 61, rather than being bonded onto or otherwise secured to these surfaces. This construction is illustrated in FIG. 5 and exaggerated for clarity. As a result of such partial embedding, the outer surface of the portion 72 of the woven polymeric fabric layer 70 is substantially flush with the radially inner surface 67 of the strip 61 and the outer surface of the portion 73 is substantially flush with the radially outer surface 68 (FIG. 7) of the strip. Partial embedding of the layer of woven polymeric fabric 70 in the elastomeric strip 61 may be accomplished when the elastomeric material 61 is vulcanized.

Referring now to FIGS. 8 and 9, an alternate construction, indicated generally at 80, of the layer of woven polymeric fabric or cloth of the previous embodiment is illustrated. The layer of polymeric fabric 80 may be of the same proportions and material as the layer 70, and likewise may be secured to the radially inner and outer surfaces 67 and 68, respectively, of the strip 61 in the same manner as the polymeric fabric layer 70. The layer 80 differs, however, from the layer 70 in that the layer 80 is formed in separate pieces, some of which are indicated at 80*a*–80*d*, respectively, in FIGS. 8 and 9. The pieces of woven fabric which make up the layer 80 are preferably about 2 inches (5.08 cm.) wide and are separated by slits or gaps, indicated at 82, which extend perpendicularly or radially with respect to the outer edge 63 of the elastomeric strip 61. Consequently, the pieces of polymeric fabric which make up the layer 80 likewise extend perpendicularly or radially with respect to the radially outer edge 63 of the elastomeric strip. Because the strips 80*a*–80*d* are separated by the gaps or slits 82, the material of the radially outer edge portion 62 of the strip 61 is free to expand or stretch when out-of-round areas in the tank sidewall or shell are encountered during movement of the roof 12.

Referring now to FIG. 10, another alternate construction, indicated generally at 90, of the layer of polymeric fabric that is carried on the radially inner and outer surfaces 67 and 68, and edge 63 of the elastomeric strip 61 is illustrated, the layer 90 differing from the layers 70 and 80 in that the layer 90 is formed from nonwoven random fibers, matted together as a felt. Otherwise, the layer of polymeric fabric 90 is applied to portions of the radially inner and outer surfaces 67 and 68 of the strip 61, and the radially outer edge portion 62 thereof in the same manner as either the layer 70 or the layer 80 of polymeric fabric. In addition, the layer of polymeric fabric 90 is also preferably at least partially embedded in the elastomeric strip 61, rather than being bonded or otherwise secured to the radially inner and outer surfaces 67 and 68 of the strip 61.

While several embodiments of the invention have been herein illustrated and described, it will be understood that modifications and variations thereof may become apparent to those skilled in the art without departing from the spirit of the invention and the scope of the appended claims.

What is claimed is:

1. An elongated elastomeric composite strip with laterally spaced side edges, impermeable to petroleum vapor and useful as a seal in a floating roof tank, said elastomeric strip having a layer of polymeric fabric carried thereon along at least one side edge adapted to contact a floating roof tank side wall, with the layer having a substantially lower coefficient of friction than the material otherwise comprising the surface of the elastomeric strip thereby providing a slick face adapted to at all times freely slidably contact a surface with which it has contact with little or no sticking; and said layer of polymeric fabric is provided by a plurality of separate pieces, with a gap between adjacent pieces, so as to accommodate stretching of said elastomeric strip.

2. A strip according to claim 1 in which said layer of polymeric fabric is formed from woven filaments.

3. A strip according to claim 1 in which said layer of polymeric fabric is formed from nonwoven random fibers.

4. In a vertical cylindrical liquid storage tank of imprecise circularity having a circular floating roof of smaller diameter than the tank thereby defining a vapor space between the roof edge and the tank wall, and an elastomeric strip impermeable to vapor connected at its radially inner edge by an essentially vapor tight joint to the roof edge and extending as an annulus outwardly and arched upwardly or downwardly to the tank inner side wall for substantially preventing flow of vapor from a liquid product stored in the tank through the vapor space to the atmosphere, the improvement comprising:

a layer of polymeric fabric carried on that portion of the face of the elastomeric strip which is adapted to at all times make contact with the tank inner side wall, said polymeric fabric having a substantially lower coefficient of friction than that of the elastomeric strip such as to permit free sliding movement of said strip against the said tank wall to thereby negate reverse arching of the strip with vertical movement of the floating roof relative to the tank wall; and said layer of polymeric fabric is provided by a plurality of separate pieces, with a gap between adjacent pieces, so as to accommodate stretching of said elastomeric strip.

5. A strip according to claim 4 in which said layer of polymeric fabric is formed from woven filaments.

6. A strip according to claim 4 in which said layer of polymeric fabric is formed from nonwoven random fibers.

7. A strip according to claim 4 in which said pieces of polymeric fabric extend perpendicularly to and laterally inwardly from said one edge of said elastomeric strip.

8. A strip according to claim 7 in which the width of each of said pieces of polymeric fabric is about 2 inches (5.08 cm.).

9. A strip according to claim 7 in which said elastomeric strip has opposite surfaces, and a portion of each piece of said polymeric fabric is carried on each of said surfaces.

10. A strip according to claim 4 in which said layer of polymeric fabric is nonremovably attached to said elastomeric strip.

11. A strip according to claim 10 in which said layer of polymeric fabric is at least partially embedded in said elastomeric strip.

12. A strip according to claim 4 in which said polymeric fabric is of nylon, polyethylene, a polyfluoroethylene or a polychlorofluoroethylene.

* * * * *